United States Patent [19]

Wood

[11] 4,033,386

[45] July 5, 1977

BEST AVAILABLE COPY

[54] WIRING HEAD WITH RESILIENTLY LOCKED AND RESETTABLE GUIDE TUBE MOUNTING ASSEMBLY

[75] Inventor: Virgil W. Wood, Rockwall, Tex.

[73] Assignee: Western Electric Company, Inc., New York, N.Y.

[22] Filed: Dec. 18, 1975

[21] Appl. No.: 642,044

[52] U.S. Cl. ..... 140/92.1; 140/93 R; 29/755

[51] Int. Cl.[2] ..... B21F 27/00

[58] Field of Search ..... 29/203 MW, 203 B; 140/93 R, 113; 226/100, 196, 198; 242/157 R, 157.1, 222, 148; 285/1, 190, 268, 262, 275; 403/225, 226, 228, 263; 72/5

[56] References Cited

UNITED STATES PATENTS

| | | | |
|---|---|---|---|
| 2,350,808 | 6/1944 | Peglau | 285/190 |
| 3,485,458 | 12/1969 | Evans | 242/157 R |
| 3,947,943 | 4/1976 | Kokubo et al. | 140/92.1 |

FOREIGN PATENTS OR APPLICATIONS

| | | | |
|---|---|---|---|
| 1,299,336 | 7/1969 | Germany | 140/71 |

*Primary Examiner*—Lowell A. Larson
*Attorney, Agent, or Firm*—K. R. Bergum; R. P. Miller

[57] ABSTRACT

A wiring head housing, particularly adapted for use in an automatic cable harness forming machine, incorporates a uniquely mounted, resiliently locked and resettable guide tube assembly that allows a guide tube, while being moved horizontally in accordance with a programmed pattern along an X-Y coordinate plane, for example, to be tilted up to a predetermined maximum degree of inclination, upon hitting an obstruction, in any direction from the predetermined resiliently locked position, while remaining secured to the wiring head. The spring means for resiliently locking the guide tube assembly continuously engages a rotatable member thereof in such a way, and is of such a type, that it is expanded in response to the guide tube being tilted in any direction. Such spring expansion (or displacement) is optionally employed to actuate a machine turn-off switch positioned adjacent thereto.

18 Claims, 5 Drawing Figures

WIRING HEAD WITH RESILIENTLY LOCKED AND RESETTABLE GUIDE TUBE MOUNTING ASSEMBLY

BACKGROUND OF THE INVENTION

1. Field of the Invention

This invention relates to automatic wire-laying apparatus and, more particularly, to the wiring heads employed in an automatic cable harness forming machine.

2. Description of the Prior Art

Until the recent development of automatic cable harness forming machines, such harnesses, employed extensively in many complex electronic systems, such as telephone switching equipment, PBX's, and computers, to mention but a few, were almost exclusively formed manually. This entailed laying out the various colored (or otherwise coded) wires on wiring boards having an array of pins supported and arranged thereon in accordance with a pattern corresponding to a set of written instructions for a particular cable harness. Such a procedure is obviously time consuming, tedious and expensive.

In an attempt to speed up the manual operations in forming a cable harness and, particularly, the laying out of the wires to form a patterned array, a number of visual and audio systems have been proposed and/or used heretofore. These systems, for example, have employed television monitors and/or speakers, or earphones, to provide the assembler with step-by-step wiring instructions. A related system is disclosed in U.S. Pat. No. 3,163,296, of E. W. Gray, wherein indicating lamps adjacent the wiring pins are selectively operated to indicate to the assembler the particular route that a given wire is to follow. Regardless how the wires are laid out along the various prescribed paths between selected pins, they are, of course, thereafter bound, cut and the ends thereof selectively stripped of insulation to form the finished cable.

While these latter approaches to forming cable harnesses have proved to be of considerable assistance to the assembler, it was not until the advent of automated cable forming machines that the time and costs involved in forming complex cable harnesses were substantially reduced. One such machine with which the present invention is primarily concerned, is disclosed in B. H. Hobbs et al U.S. Pat. No. 3,907,007, issued Sept. 23, 1975, and assigned to the same assignee as the present invention.

In that cable forming machine, the wires are automatically laid out on a wire-receiving board or frame, typically in accordance with a programmed X-Y coordinate pattern. The machine includes a bank of wiring heads, one for each wire or set of wires, and through which the wires extend from respective tensioning devices and supply reels. The wiring heads are releasably attached to respective seats, and selectively coupled to a wire positioning device mounted for movement in accordance with an X-Y coordinate wiring pattern, with periodic displacement in the Z direction.

Each of the wiring heads in one prior embodiment of the above-described machine has included a resiliently mounted, and downwardly extending wire guide tube. As constructed, the prior guide tube mounting assembly allowed the guide tube to "pop-out" upon hitting an obstruction, such as a slightly bent pin or an abnormally raised wire. This, in turn, actuated a pair of orthogonally positioned switches to turn off the machine.

Disadvantageously, whenever a given guide tube would pop-out of the wiring head, it could only be remounted by partially dismantling the wiring head. Having to remount the guide tube, even infrequently, has proved to be not only time consuming, but costly, because of the necessary down-time of the machine.

SUMMARY OF THE INVENTION

In accordance with the principles of the present invention, and in one preferred illustrative embodiment, each of the wiring heads, particularly adapted for use in an automatic cable harness forming machine, includes a unique spring-biased ball and socket guide tube mounting assembly confined within a central opening extending through the wiring head housing. The guide tube is secured at one end to the ball, and is aligned with a central bore extending through the latter. An expandable, and preferably annular, spring is normally partially seated within a circumferentially disposed groove formed in the ball. A slot formed in the socket-defining wall portion of the wiring head is laterally and circumferentially disposed so as to communicate with the groove in the ball, and normally accommodates, in a fixed position, a portion of the spring such that the ball is resiliently locked in a desired operating position (whereat the guide tube in the illustrative embodiment extends vertically downward).

In response to the guide tube hitting an obstruction, the ball is rotated from its resiliently locked position, causing the spring to be expanded while being forced out of the groove, and displaced laterally into the slot of the socket. This unlocks the ball for rotation and, thereby, allows the guide tube secured thereto to be tilted to any predetermined maximum angle of inclination, preferably defined within an imaginary surface of an inverted cone, with the fixed axis center of rotation of the rotatable ball being the apex of the cone. The capability of the spring to expand radially also advantageously allows a single microswitch mounted adjacent thereto to actually sense the tilting of the guide tube in any direction relative to its normal position, and turn off the machine.

As thus described, the present wiring head incorporates a uniquely mounted, resiliently locked and resettable guide tube that advantageously minimizes costly down-time of the wiring machine as a result of the guide tube being tilted upon hitting an obstruction, and allows the use of a single microswitch to sense the tilting of the guide tube in any direction.

DETAILED DESCRIPTION OF THE INVENTION

Figure 1:
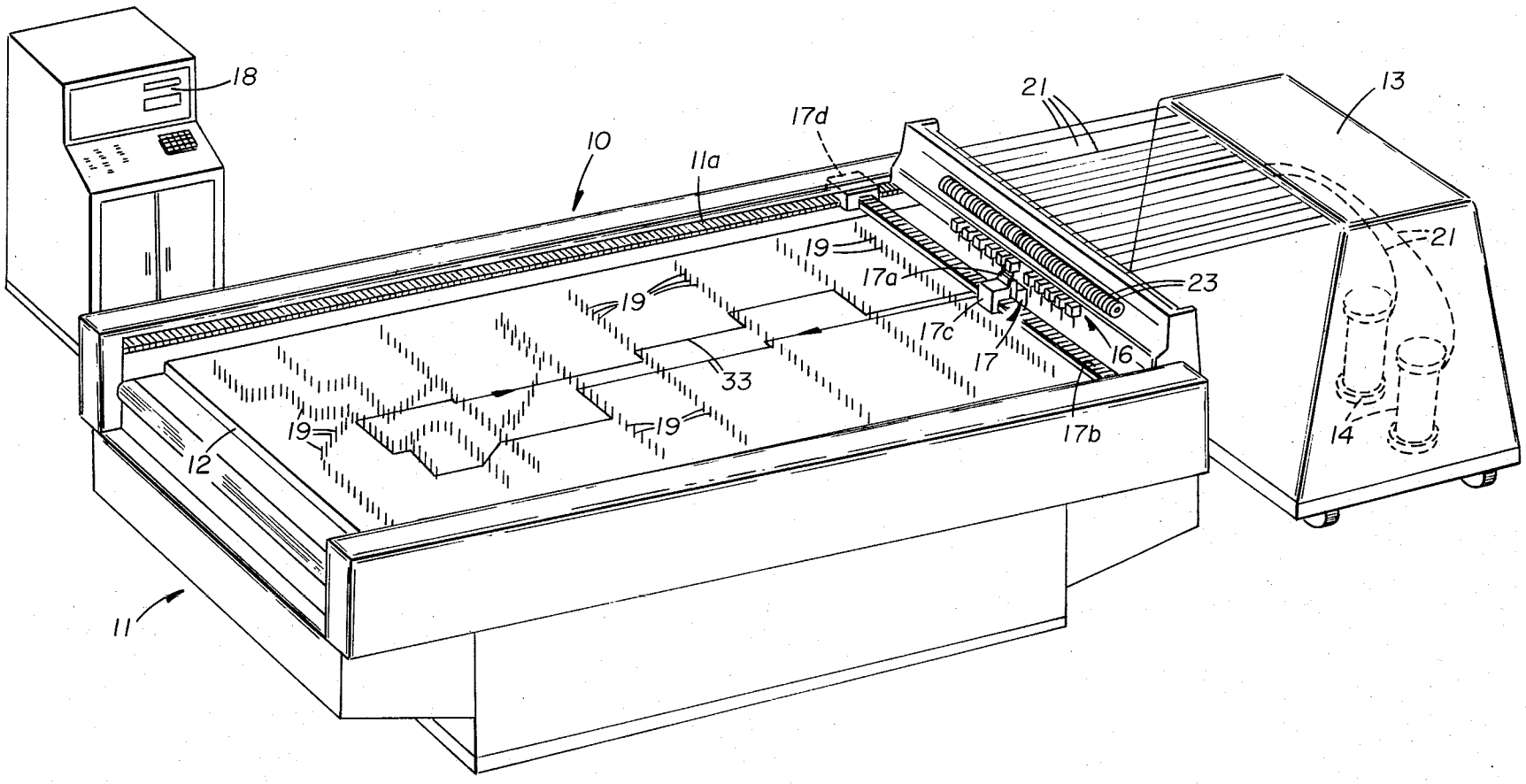
FIG. 1 is an isometric view of an automatic cable harness forming machine incorporating wiring heads with resiliently mounted guide tubes of the type embodied herein.

Background of the Associated Cable Forming Machine

It should be appreciated that the resiliently mounted and resettable guide tube assembly as embodied herein, and described in greater detail hereinafter, has universal application in many diverse types of apparatus, but for purposes of illustration, it is disclosed herein in connection with one preferred application, namely, for use in the wiring heads of an automatic cable harness forming machine of the type depicted in FIG. 1, and identified generally by the reference numeral 10.

Figure 2:
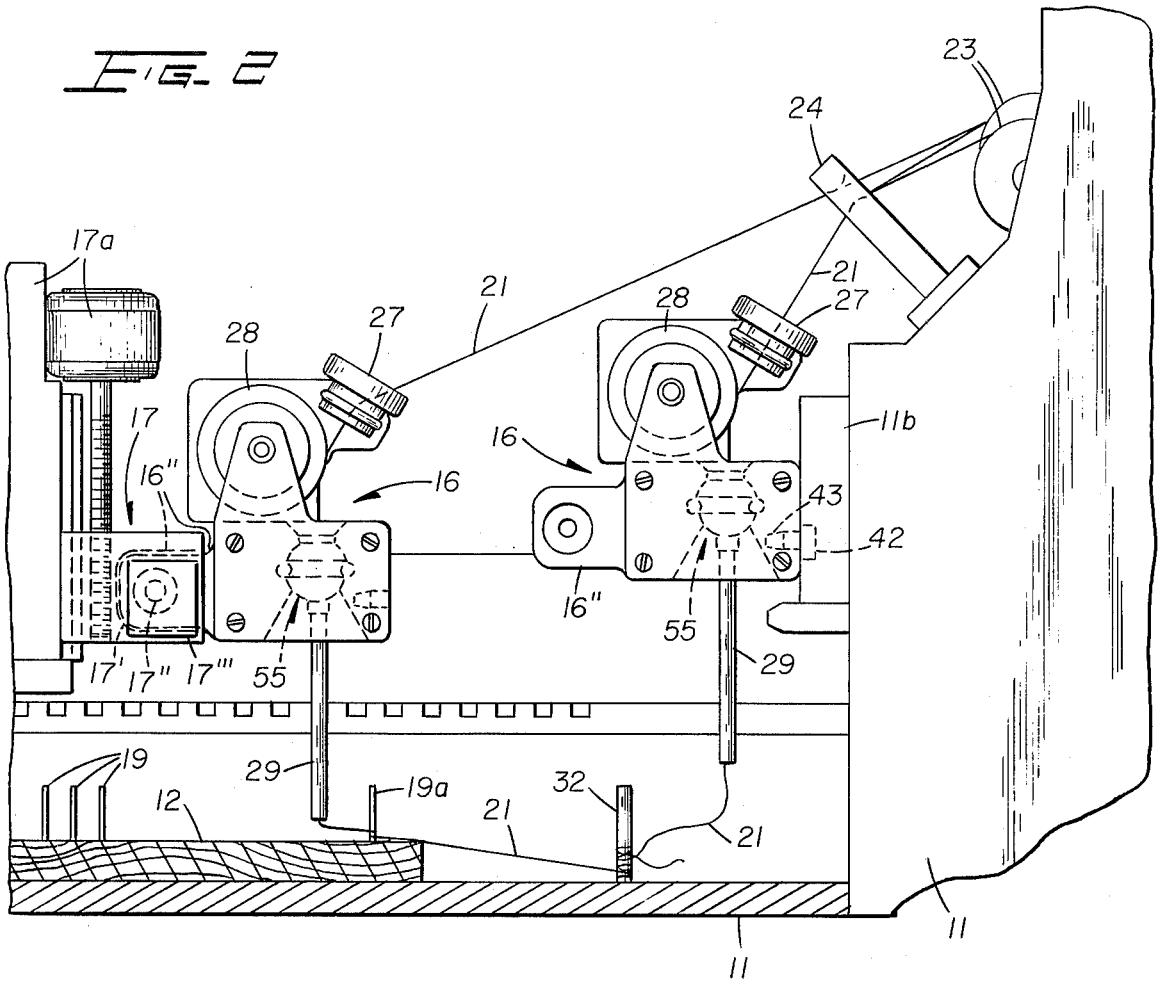
FIG. 2 is an enlarged, side elevational view, partially in section, illustrating a wiring head in a wire laying phase of operation in the apparatus of FIG. 1.

With particular reference now to both FIGS. 1 and 2, it is seen that the machine 10 includes a support table 11 upon which a planar cable forming board (or frame) 12 is removably positioned and clamped, a wire dispensing cart 13 having a plurality of wire supply reels 14 mounted thereon, and a bank of wiring heads 16 located adjacent one end of the support table. The wiring heads are separately movable over the cable forming board relative to, and independently of, each other and the wire supply reels. To accomplish such movement, a wire positioning device 17 is mounted on the support table for movement in X, Y and Z directions in response to a programmable controller 18 operated, for example, in response to a programmed punched tape.

The positioning device 17 is mounted for vertical (Z) movement on a motor-driven carriage 17*a* (see FIG. 2), with the latter mounted for lateral (Y) movement on a beam 17*b*, extending transversely above the top of the support table 11. The beam 17*b*, in turn, is mounted for longitudinal (X) movement along a pair of tracks 11*a* (only one seen in FIG. 1) extending along opposite sides of the table 11. As described in greater detail in the aforementioned Hobbs et al patent, both Y movement of the carriage 17*a*, and X movement of the beam 17*b*, is preferably effected through the use of linear reluctance motor systems, designated generally by the reference numerals 17*c* and *d*, respectively, operating on an air-flotation principle.

The wire positioning device is adapted to couple itself selectively to the wiring heads 16 and driven them successively along the desired wiring route. The actual cable harness formed in accordance with a programmed wiring pattern would typically be comprised of one or more main trunks, with any chosen number of junctions therealong leading to any desired number of branches and sub-branches. Such a cable harness is readily formed on the wiring board 12 by utilizing a plurality of upwardly projecting wiring pins 19 located at selected wiring points or sites, preferably arranged in an X-Y coordinate array. The spacing between pins, of course, would be primarily dependent on the complexity of the cable harness being formed.

Upon each wire 21 being selectively drawn off an associated supply reel 14, it is then normally passed through a back-tensioning mechanism (not shown) and a wire-sensing mechanism, only two sheaves 23 of which are shown in FIG. 2, and an eyelet-type guide 24 fixedly mounted on an upstanding frame portion of the support table 11. From the guide 24, each wire 21 travels downwardly through a second fixed eyelet-type guide 27 mounted on the respectively associated one of the wiring heads 16. The wire then makes one or more turns about a rotatable feed capstan 28 (best seen in FIG. 3) before passing downwardly through a central opening in the wiring head, and finally through a wire guide 29. Details with respect to the opening through the wiring head, and of the manner in which the guide tube 29 is mounted in the latter will be described in greater detail hereinbelow.

The end portion of the wire 21 projecting from the lower end of each guide tube 29, as best seen in FIG. 2, is anchored against movement by being hand wrapped, for example, around a respectively associated one of a plurality of upstanding pins 32 mounted on a base portion of the support table 11, best seen in FIG. 2.

In a typical cable forming operation, the wire positioning device 17 (FIG. 2), under the programmed control of the controller 18 (FIG. 1), initially moves to a position adjacent one of the uncoupled banks of wiring heads 16 (right-most position in FIG. 2), and attaches itself to a selected one thereof. This may be accomplished, for example, by providing each wiring head 16 whith an apertured latchable support lug 16'', and the positioning device with a correspondingly shaped and recessed seat 17'. An actuable device 17'' mounted on the device 17 selectively actuates a pin 17''' into engagement with the aperture in the lug 16''. Such a selective coupling arrangement is disclosed in greater detail in the aforementioned Hobbs et al patent.

However accomplished, once the positioning device 17 is coupled to a selected wiring head 16, the latter is removed from a parking bar (see FIG. 2), in the form of a fixed frame member 11*b* forming part of the support table, and routed over the cable forming board 12. In the process, the associated wire 21 is laid out on the board along and about the selected pins 19 in accordance with a predetermined programmed pattern under the control of the controller 18. One typical wiring pattern is identified by the numeral 33 in FIG. 1, with the direction of wire movement being indicated by arrows.

To effect the reliable securement of the wiring heads 16 to the stationary parking bar 11*b* when not in use, each parking seat along the bar may be formed with a permanent magnet 42 (FIG. 2) and one or more guiding dowel pins 43 on either side thereof, for example. For this purpose, the wiring head housing is formed with a dowel-accommodating recess 41, and may either be formed of ferromagnetic material, or have a ferromagnetic member 44 (FIGS. 3–5), for example, mounted thereon in alignment with the associated magnet 42. It is appreciated, of course, that either electromechanical or mechanical coupling apparatus could also be employed. For example, an outwardly extending mechanical latch pin (not shown) on the wiring head 16 and a perpendicularly disposed spring-loaded plunger (not shown) in the parking bar 11*b* could also be employed.

Referring again to a typical cable forming operation, it should be noted that the wire positioning device 17 initially routes the particular coupled-wiring head 16 to a preselected one of a plurality of "start" anchor pins 19*a* arranged in a row on the cable forming board 12 adjacent its righthand end, as viewed in FIGS. 1 and 2, and automatically wraps the wire 21 about the anchor pin. The particular anchor pin which is utilized is dependent upon the point at which the laying of the wire 21 on the cable forming board 12 is to begin.

When the laying of the wire 21 has been completed, the wire positioning device 17 again causes the wire to be wrapped about the initial start anchor pin 19*a*, returns the coupled wiring head 16 to the stationary parking bar 11*b*, and then uncouples itself from the wiring head. Whenever one of the wire runs terminates at an intermediate point along the cable forming board 12, the wire positioning device 17 is displaced to and proceeds along the outer periphery of the board back to the initial start anchor pin 19*a*.

This sequence of operations is repeated by the wire positioning device 17 with selected and successive ones of the wiring heads 16, with associated wires 21 fed therethrough, until the desired layout for a particular cable harness has been completed. The wire 21 are then cut between the anchor pins 19*a* on the cable forming board 12 and the anchor pins 32 on the bed of the support table 11, and between the anchor pins 19*a* and the guide tubes 29, whereupon the cable forming board 12 may be removed from the support table 11 and replaced with another board, with the wires being maintained in their desired positions on the first board as a result of their having been wrapped about the anchor pins 19*a* thereon. The wires 21 on the first cable forming board 12 are then bound in a suitable manner, cut and the ends stripped as necessary to form the individual wires associated with the various trunks and branches that make up the completely fabricated cable harness.

For further details of the overall cable harness forming machine, and of its mode of operation described only briefly hereinabove, reference is again made to the aforementioned Hobbs et al patent.

Resiliently Locked and Resettable Guide Tube Mounting Assembly

As previously mentioned, the guide tube 29 generally is mounted to normally extend downwardly from the wiring head 16, and has been mounted within the latter heretofore in accordance with one prior embodiment such that it would pop-out in order to reduce the possibility of damage to the machine should the guide tube strike an obstruction, such as one of the upstanding pins 19 on the cable forming board 12, or strike any other obstruction for any reason. Such a popped-out guide tube, while being adapted to actuate switch means to turn off the machine, unfortunately required the partial dismantling of the wiring head in order to remount the guide tube therewithin. This operation was not only time consuming itself, but quite costly because of the down-time of the entire machine.

Figure 3:
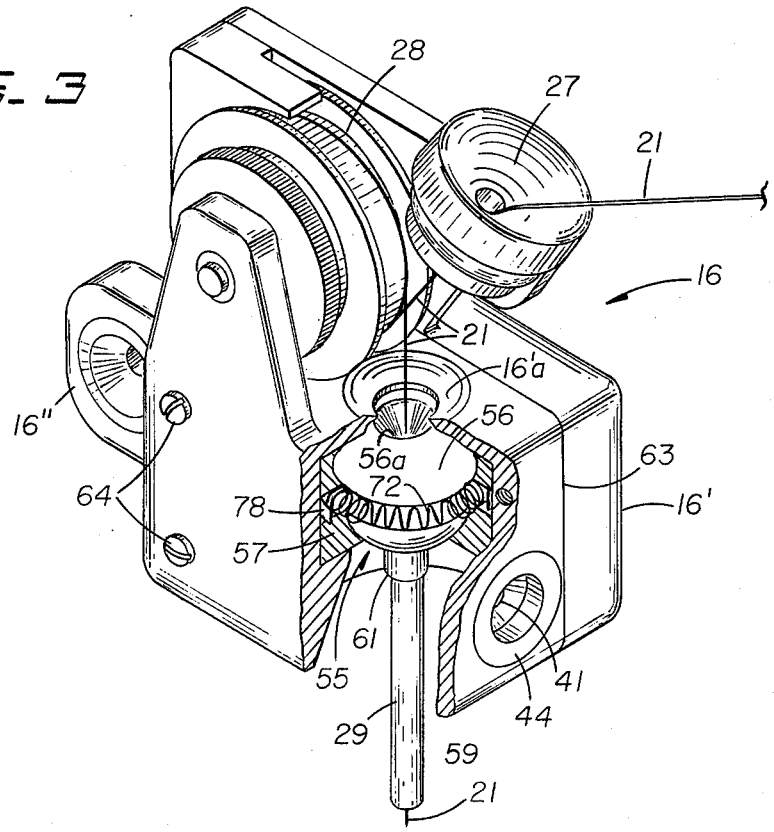
FIG. 3 is an enlarged, perspective view of one of the wiring heads constructed in accordance with the principles of the present invention.
Figure 4:
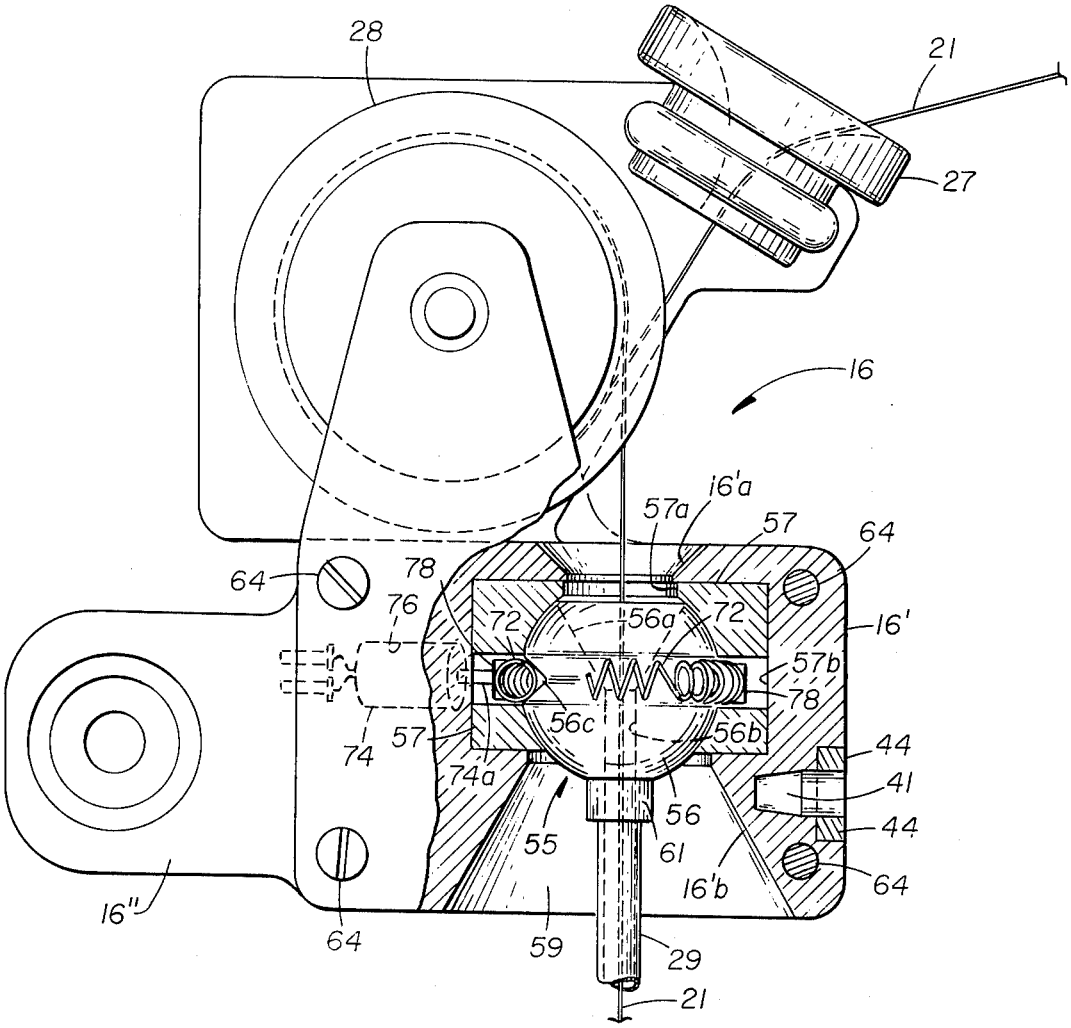
FIG. 4 is an enlarged, side elevational view, partially broken away in section, illustrating in greater detail the manner in which the guide tube is mounted and resiliently locked in a desired position within the wiring head housing.
Figure 5:
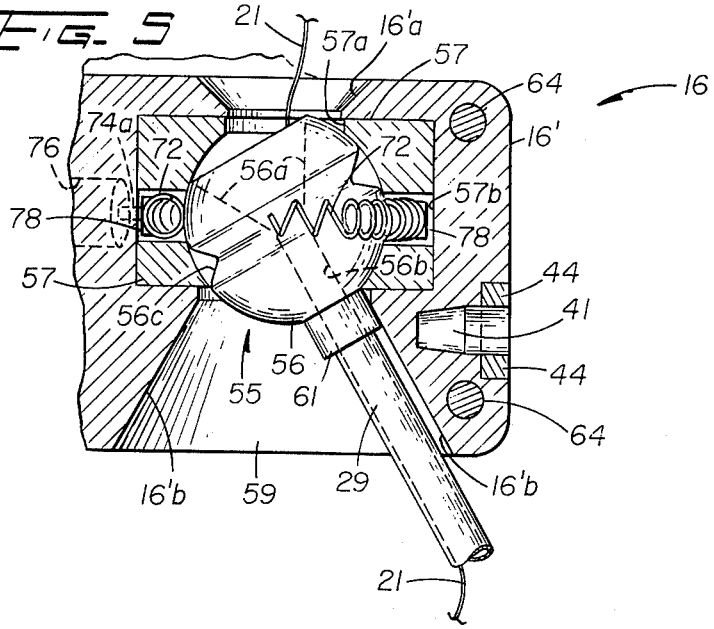
FIG. 5 is an enlarged, detail fragmentary view of the guide tube mounting assembly depicted in FIG. 4, but with the guide tube in an unlocked, tilted position of maximum inclination, and with switch means illustrated, and shown in an actuated state as a result of the tilted position of the guide tube, in accordance with the principles of the present invention.

With particular reference now to FIGS. 3–5, there is illustrated a unique spring-biased guide tube mounting assembly identified generally by the reference numeral 55, mounted within the wiring head 16, and embodying a number of features in accordance with the principles of the present invention. As best seen in FIG. 4, the guide tube assembly 55 comprises a substantially spherical ball 56 on which the guide tube 29 is supported, and a socket 57 mounted within a central opening 59 extending through the wiring head housing 16′. As illustrated, the socket 57 is preferably formed as a snug-fitting split insert made, for example, of easily machineable metal, such as brass, or a suitable molded plastic.

The wiring head housing 16′ is preferably formed in two halves, such as along the parting line 63 depicted in FIG. 4. With the two halves of the housing being secured by suitably threaded fastening members, such as the four bolts 64 illustrated, the ball and socket assembly 55 may be readily mounted within the housing opening 59 as an assembled unit, with or without the guide tube 29 secured thereto.

The ball 56, as best seen in FIGS. 4 and 5, is formed with an upper cone-shaped orifice 56*a* that merges into an axially disposed bore 56*b* for receiving and passing a wire 21 from the capstan 28 therethrough. In order to facilitate such wire feed-through, the cone-shaped orifice 56*a* is dimensioned at its outer peripheral end so as to normally substantially merge into the upper aperture 57*a* formed in the insertdefining socket 57, with the latter aperture merging into a similarly dimensioned, but outwardly beveled upper opening 16′a of the housing 16′. The lower end of the bore 56*a* is either formed with, or otherwise has secured thereto, an axially aligned collar 61 adapted to receive and suitably support the upper end of the guide tube 29. To this end, the guide tube may be secured to the collar by threaded or force-fit engagement, or by separate fastening means (not shown) if desired.

In accordance with the principles of the illustrative embodiment, the ball 56 is not only mounted for rotation about its fixed-axis center of rotation, while being otherwise confined by the socket 57, but is normally resiliently locked within the socket 57 such that the bore 56*b* therethrough is axially aligned with the axis of the opening 59 extending through the housing 16′. This is accomplished in conjunction with a specially seated and expandable spring 72. More specifically, a circumferentially disposed groove 56*c*, preferably of V-shaped configuration, is formed in the ball 56 in a plane perpendicular to the axis of the bore 56*b* therethrough. The groove 56*c* is dimensioned so as to only partially receive and seat the spring 72 therein.

As also best seen in FIGS. 4 and 5, the insert defining socket 57 is formed with a laterally and circumferentially disposed slot 57*b* that is dimensioned to have a width just slightly larger than the diameter of the spring 72, and positioned so as to normally communicate with the V-shaped groove 56*c* of the rotatable ball 56 whenever the latter is in its normally desired angular position. In that position, the spring 72 only partially protrudes into the aligned slot 57*b* such that the groove-seated spring normally maintains the rotatable ball 56 in its resiliently locked position, whereat the bore 56*b* therethrough axially aligned with the axis of the opening 59 extending through the housing 16′. This, of course, also results in the guide tube 29 being resiliently locked in a vertical, downwardly extending position for normal use. Conversely, whenever the spring is forced out of the V-shaped groove 56*c* and into the slot 57*b*, in response to angular displacement of the ball 56, both the ball and guide tube are in an unlocked condition.

Angular displacement of the ball 56, and the responsive expansion of the spring 72, of course, is effected whenever the guide tube 29 hits an obstruction while being moved along an X-Y plane. As previously mentioned, such an obstruction may result, for example, from any one of the following conditions: a bent wiring pin 19, an abnormally elevated wire 21 (as laid), an error in the X-Y-Z program for a given wiring pattern, or a malfunction in the controller 18.

Regardless of the nature and cause of the obstruction, whenever the guide tube 29 starts to tilt, and the ball 56 responsively starts to rotate, it is the relative movement between the spherical side wall portions of the latter (of nominal radius), and the closely mating spherical wall portions of the insert-defining socket 57, that causes the coil spring 72 to be forced out of the V-shaped groove 56*c* of the ball, and into the accommodating slot 57*b* of the socket, as depicted in FIG. 5.

The degree of lateral force that must be exerted on a lower end region of the guide tube 29 to cause the ball 56 to be rotated from its normal resiliently locked position will depend on the elastic characteristics of the particular spring 72 employed in the wiring head 16. In connection with this spring, it should be appreciated that it may either be of the continuous type, i.e., in the form of an annulus, or comprise a split or C-shaped ring, and be of either solid core or tubular cross-section, as long as it has the desired dimensions and elastic characteristics required. In the illustrative embodiment, the spring 72 comprises a continuous, helically wound coil made, for example, out of 0.033 diameter music wire, or any other suitable heat tempered steel wire.

It should also be understood that both the rotatable ball 56 and guide tube 29 may be resiliently locked at any number of chosen angles of inclination relative to the vertical position illustrated herein. Similarly, it should be understood that the angular displacement of the ball 56 and guide tube 29 into an unlocked position may encompass all possible angles of orientation falling within a predetermined maximum degree of angular displacement in any given direction relative to the locked position.

The possible unlocked angles of inclination of the guide tube 29 can be envisioned as encompassed within an imaginary surface of an inverted cone, with the apex thereof being the fixed axis center of rotation of the rotatable ball 56 to which it is secured. As described hereinabove, the surface of such an inverted cone is actually defined in the illustrative embodiment by the outwardly tapered surface 16'*b* which forms the lower opening in the wiring head housing 16'. It is apparent, of course, that a surface or an abutment of the insert-defining socket 57, as well as any other surface or an abutment of the outer housing 16', may constitute a stop that would define the maximum degree of angular orientation of the ball 56, and guide tube 29. Regardless what determines the maximum angle of inclination for the guide tube, it may be simply returned to its normal, resiliently locked vertical position by a small manual force exerted laterally against a lower end portion thereof. As the spring 72 recedes into the groove 56*c* of the ball, it produces a snapaction effect which clearly indicates to an operator that the guide tube has been reset. Such re-positioning of the guide tube 29 would normally be done after whatever caused it to be tilted had been corrected, but could be done before provided a fail-safe switch was built into the machine, as will be described in greater detail hereinbelow.

The utilization of the expandable annular spring 72, in conjunction with both the aligned spring-accommodating groove 56*c* in the ball 56, and the accommodating slot 57*b* in the socket 57, also serves another very significant function. More specifically, whenever the spring 72 is expanded sufficiently so as to be displaced completely within the slot 57*b* of the socket 57, this not only substantially frees the previously resiliently locked ball 56 (as well as guide tube 29) for angular displacement, but such spring displacement is also employed to actuate a microswitch 74 (FIG. 4). This switch is preferably wired to the drive source (not shown) of the positioning device 17, or to the controller 18, in either case to turn off the machine. Should the switch 74 be further wired in such associated apparatus so as to de-actuate a fail-safe type of manually operated switch in the latter, then any angularly deflected guide tube could be re-positioned either before or after the cause for it being deflected was corrected.

The microswitch 74 is readily mounted within a bore 76 formed in the wiring head housing 16', which bore communicates with the annular slot 57*b* of the socket 57. In order to insure that the outer end of the piston-type contact 74*a* of the microswitch could never extend through two adjacent turns of the coil spring 72 while expanded (or between the non-coiled connecting ends thereof, or between the opening defined by an expanded discontinuous C-type spring) and, thereby, not be actuated, a leaf spring 78 is circumferentially disposed about the coil spring 72, and confined within the slot 57*b*. The leaf spring may comprise, for example, either a suitable thin walled metal or plastic tape, treated to have a natural tendency to coil. The leaf spring 78 is also formed with sufficient length so as to insure the continuous overlap of the ends thereof when the coil spring 72 is fully expanded within the slot 57*b*.

Alternatively, the terminating end of the microswitch contact 74*a* may also be formed with, or have secured thereto, a sufficiently large nose portion that would insure the actuation of the switch under all normal conditions involving the expansion and possible circumferential shifting of the spring 72, at least when the latter is of the continuous or annular type, as illustrated.

In any event, it is appreciated, of course, that it is the utilization of the annular spring 72 (with or without a leaf spring 78), which is radially expandable in response to the rotation of the grooved ball 56, relative to the stationary slotted socket 57, that allows a single properly positioned microswitch to be actuated, regardless of the direction of rotation of the ball (or direction of tilt of the guide tube).

In view of the foregoing, it is obvious that various modifications may be made to the present illustrative embodiment of the invention, and that a number of alternatives may be provided without departing from the spirit and scope of the invention. For example, the central opening in the wiring head housing could be readily formed with spherical socket-defining wall portions so as to accommodate the rotatable spring-biased ball without the need of a separate insert forming the socket. Similarly, the rotatable ball need not be even substantially spherical, but rather, could actually take the form of a modified spherical bearing. In that case, the inner race would be formed with the desired circumferentially disposed groove, and confined for angular orientation within the outer stationary race having a circumferentially disposed spring-receiving slot or groove formed therein, with both races being essentially of cylindrical configuration, albeit having semicircular mating surfaces.

In summary, a wiring head particularly adapted for use in an automatic cable harness forming machine has been disclosed which incorporates a uniquely mounted, resiliently locked and resettable guide tube assembly comprised of a specially configured ball, socket and expandable annular spring, and being of simplified, rugged and inexpensive construction. This assembly operates in such a manner that the guide tube secured to the ball may be deflected into an unlocked tilted position in any direction upon hitting an obstruction, while remaining mounted within the wiring head, thereby eliminating costly down-time of the machine. In addition, the uniquely positioned and expandable annular spring allows a single microswitch positioned adjacent thereto to be responsively actuated whenever the guide tube is tilted in any direction from its normal resiliently locked position.

I claim:

1. A wiring head for use in guiding wire along a predetermined path, said wiring head including:

housing means having an opening extending centrally therethrough;

multi-directional rotatable means mounted within said opening, and confined for movement about a fixed axis center of rotation, said rotatable means having a central bore extending therethrough;

expandable spring means communicating with said opening for normally resiliently locking said rotatable means into a predetermined position whereat the bore therethrough communicates with the opening through said housing; said spring means upon being expanded allowing the orientation of said rotatable means into an unlocked position encompassing all possible angles of orientation falling within a predetermined maximum degree of angular displacement in any given direction relative to said locked position, and a wire guide tube secured to said rotatable means, with the bore through the former communicating with the bore through the latter, said guide tube thereby being capable of being tilted from a normal resiliently locked position to any other angle of inclination corresponding to that acquired by said rotatable means, with any force-induced tilting of said guide tube causing said spring means to expand.

2. A wiring head in accordance with claim 1 wherein said rotatable means comprises a substantially spherical member having a peripheral groove formed therein along a plane perpendicular to the axis of said bore formed therethrough, wherein said spring means comprises at least a substantially annular member circumferentially disposed at least substantially around said spherical member and dimensioned so as to be capable of being only partially confined within the groove thereof, and wherein said housing means includes at least a substantially annular slot, laterally and circumferentially disposed so as to accommodate said expandable member whenever the latter is expanded and forced out of said groove of said spherical member in response to the latter being oriented from the normally resiliently locked position thereof by deflection of said guide tube.

3. A wiring head in accordance with claim 2 wherein said housing means comprises an outer housing and an inner insert mounted within said opening formed in said outer housing, said insert having a bore therethrough that is axially aligned with the axis of said outer housing opening, and said insert having a central contoured cavity that is axially aligned with and communicates with said bore therethrough, and is dimensioned with partially spherical walls that closely mate with respective spherical wall portions of said rotatable spherical member, said insert further having said slot extending laterally at least partially therethrough so as to communicate with said groove formed in said spherical member when in its normal, resiliently locked position.

4. A wiring head in accordance with claim 3 wherein said expandable member comprises a helical coil spring, wherein the maximum angle of inclination of said guide tube is restricted by an outwardly tapered wall portion that defines the lower terminating end region of the opening in said outer housing, and wherein the upper end of the bore through said spherical member is formed with an outwardly tapered wall region that allows the latter when resiliently locked to at least substantially merge into both the upper end of the bore in said insert and the adjacent upper end of the opening in said housing, with the peripheral edge of the latter opening being smoothly contoured so as to allow a wire to be fed through the wiring head from any angle without being severely bent.

5. A wiring head in accordance with claim 2 wherein switch means communicates with said slot formed in said housing means, and being actuated whenever said annular member is expanded so as to be at least partially displaced into said slot.

6. A wiring head in accordance with claim 4 wherein switch means communicates with said slot formed in at least said insert, and being actuated whenever said coil spring is expanded so as to be at least partially displaced into said slot.

7. A wiring head for use in guiding wire along a predetermined path, said wiring head including:

housing means having an opening extending centrally therethrough;

a multi-directional rotatable member of substantially spherical shape mounted within said opening, and confined for movement about a fixed axis center of rotation, said rotatable member having a central bore extending therethrough;

expandable spring means circumferentially disposed about and cooperating with said spherical member for normally resiliently locking the latter into a predetermined position whereat the bore therethrough communicates with the opening through said housing, said spring means upon being expanded allowing the orientation of said rotatable means into an unlocked position encompassing any one of all possible angles of orientation defined within a predetermined acute angled imaginary surface of a cone, and a wire guide tube, the upper end of which is secured to said spherical member adjacent the lower end of the bore therethrough such that the axis of said guide tube and bore are in axial alignment, said guide tube thereby being capable of being tilted from said normal resiliently locked position to any other angle of inclination corresponding to that acquired by said spherical member, and with any force-induced tilting of said guide tube causing said spring means to expand.

8. A wiring head in accordance with claim 7 wherein:

said rotatable member comprises a substantially spherical member having a peripheral groove formed therein along a plane perpendicular to the axis of said bore formed therethrough, wherein said spring means comprises at least a substantially annular member circumferentially disposed at least substantially around said spherical member and dimensioned so as to be capable of being only partially confined within the groove thereof, and wherein said housing means includes at least a substantially annular slot, laterally and circumferentially disposed so as to accommodate said spring member whenever the latter is expanded and forced out of said groove of said spherical member in response to any force-induced tilting of said guide tube.

9. A wiring head in accordance with claim 8 wherein the bore of said spherical member is axially aligned with both the axis of the opening through said housing means, and the axial bore through said guide tube while said spherical member is in said resiliently locked position, and said wiring head further comprising:

switch means communicating with said slot formed in said housing means, and being actuated whenever said annular member is expanded so as to be at least substantially displaced into said slot, in response to any force-induced tilting of said guide tube.

10. A strand guiding head of the type adapted to guide an advancing strand along a predetermined path, including a housing with a strand-receiving opening extending therethrough, and a strand guide assembly having a tubular end portion and an opposite end multidirectional rotatable portion with a bore extending therethrough, said rotatable portion being mounted within said housing opening and resiliently locked for one particular position relative to the axis of the latter, and said tubular portion extending outwardly from said housing, and wherein the bore of said rotatable portion communicates with both the housing opening and the bore of said tubular portion, the improvement of said combination comprising:

means for permanently confining said rotatable end portion of said strand guide assembly within the opening of said housing, and for allowing the orientation of said rotatable end portion about a fixed axis center of rotation into an unlocked position encompassing all possible angles of orientation falling within a predetermined maximum degree of angular displacement in any given direction relative to said locked position, and in further respect to the resilient locking of the upper rotatable end portion of said strand guide assembly into a desired position, the resilient means therefore comprising:

expandable biasing means which communicates with said housing opening and continuously engages said rotatable end portion of said strand guide assembly regardless of the orientation of the latter, said biasing means, upon being expanded in response to any force-induced tilting of said tubular end portion of said assembly, unlocking the assembly for relatively free movement in any angular direction defined within said predetermined maximum degree of displacement.

11. In an apparatus for forming wires in sequence on a wire-receiving member having an array of wiring points defined thereon, and wherein a wire positioning device selectively moves each of a plurality of wiring heads, each including a housing with a wire-receiving opening extending therethrough and an aligned wire guide tube extending downwardly therefrom, and having at least one wire from a respective one of a plurality of wire supplies extending therethrough, through preselected ones of the wiring points. independently of the other wiring heads and wire supplies, in accordance with a programmed sequence so as to form a predetermined pattern of wires between said wiring points, the improvement in each of said wiring heads further comprising:

multi-directional rotatable means mounted within said opening, and confined for movement about a fixed axis center of rotation, said rotatable means having a central bore extending therethrough;

expandable spring means communicating with said opening for normally resiliently locking said rotatable means in a predetermined position whereat the bore therethrough communicates with the opening through said housing, said spring means upon being expanded allowing the orientation of said rotatable means into an unlocked position encompassing all possible angles of orientation falling within a predetermined maximum degree of angular displacement in any given direction relative to said locked position, and said wire guide tube being secured to said rotatable means, with the bore through the former communicating with the bore through the latter, said guide tube thereby being capable of being tilted from a normal resiliently locked position to any other angle of inclination corresponding to that acquired by said rotatable means, with any force-induced tilting of said guide tube causing said spring means to expand.

12. In an apparatus in accordance with claim 11, said rotatable means in each of said wiring heads comprising a substantially spherical member having a peripheral groove formed therein along a plane perpendicular to the axis of said bore formed therethrough, said spring means comprising at least a substantially annular member circumferentially disposed at least substantially around said spherical member and being dimensioned so as to be capable of being normally only partially confined within the groove thereof, and said housing including an annular slot, laterally and circumferentially disposed so as to accommodate said expandable member whenever the latter is expanded and forced out of said groove of said spherical member in response to the latter being rotated from said normally resiliently locked position by deflection of said guide tube.

13. In an apparatus in accordance with claim 12, said housing comprising an outer portion and an inner portion mounted within said opening formed in said outer portion, said inner portion having a bore therethrough that is axially aligned with said opening formed through said outer portion, and said inner portion having a central contoured cavity that is axially aligned with and communicates with said bore therethrough, and is dimensioned with partially spherical walls that closely mate with respective spherical wall portions of said rotatable spherical member, said inner portion further having said housing slot formed in and extending laterally at least partially therethrough so as to communicate with said groove formed in said spherical member when in its normal, resiliently locked position.

14. In an apparatus in accordance with claim 13, said expandable member in each of said wiring heads comprising a helical coil spring, the maximum angle of inclination of said guide tube being restricted by an outwardly tapered wall portion that defines the lower terminating end region of the opening in said outer housing portion, and the upper end of the bore through said spherical member being formed with an outwardly tapered wall region that allows the latter when resiliently locked to at least substantially merge into both the upper end of the bore in said inner portion and the adjacent upper end of the opening in said outer housing portion, with the peripheral edge of the latter opening being smoothly contoured so as to allow a wire to be fed through the wiring head from any angle without being severely bent.

15. In an apparatus in accordance with claim 12, each of said wiring heads further including switch means which communicates with said slot formed in said housing, and being actuated whenever said annular member is expanded so as to be at least partially displaced into said slot.

16. In an apparatus in accordance with claim 14, each of said wiring heads further including switch means which communicates with said slot formed in at least said inner housing portion, and being actuated whenever said coil spring is radially expanded so as to be at least partially displaced into said slot.

17. In an apparatus in accordance with claim 13, said guide tube being secured at its upper end to said spherical member adjacent the lower end of the bore therethrough, with said normal resiliently locked position of said guide tube being oriented vertically, and the maximum angle of inclination for both said guide tube and aligned bore through said spherical member being restricted by an outwardly tapered wall portion of said outer housing portion through which said guide tube downwardly extends.

18. In an apparatus in accordance with claim 17, said exapndable member in each wiring head comprising an annular coil spring circumferentially disposed about said spherical member, each wiring head further including:

a thin-walled member circumferentially disposed about said spring and confined within the slot in said inner portion, said member being of sufficient length so that the ends thereof continuously overlap, and being formed out of a material that results in said member having a tendency to coil, and a microswitch positioned to communicate with said slot, and having a displaceable actuable contact disposed on the side of said thin-walled member opposite said spring, said microswitch thereby being actuated whenever said coil spring is radially expanded into said slot, causing said simultaneously expanded thin-walled member to displace said actuable contact.

* * * * *